US007410049B2

(12) United States Patent
O'Brien et al.

(10) Patent No.: US 7,410,049 B2
(45) Date of Patent: Aug. 12, 2008

(54) DIODE CUTOFF AND SAFE PACKAGING SYSTEM FOR DETONATING CORD

(75) Inventors: John P. O'Brien, Pawcatuck, CT (US); Timothy J. O'Brien, Pawcatuck, CT (US)

(73) Assignee: Detotec North America, Inc., Sterling, CT (US)

( * ) Notice: Subject to any disclaimer, the term of this patent is extended or adjusted under 35 U.S.C. 154(b) by 195 days.

(21) Appl. No.: 11/366,103

(22) Filed: Mar. 2, 2006

(65) Prior Publication Data

US 2008/0169213 A1 Jul. 17, 2008

Related U.S. Application Data

(63) Continuation-in-part of application No. 10/645,369, filed on Aug. 21, 2003, now abandoned.

(51) Int. Cl.
*B65D 81/02* (2006.01)
*C06B 21/00* (2006.01)
*C06C 5/00* (2006.01)

(52) U.S. Cl. ..... 206/3; 86/1.1; 102/275.2; 102/275.7; 102/275.12; 206/388

(58) Field of Classification Search ..... 206/3, 206/388; 86/1.1, 50; 102/275.1–275.12, 102/318, 322

See application file for complete search history.

(56) References Cited

U.S. PATENT DOCUMENTS

| | | | | |
|---|---|---|---|---|
| 3,486,410 A | | 12/1969 | Lake et al. | |
| 4,432,268 A | | 2/1984 | Miller | |
| 4,527,482 A | | 7/1985 | Hynes | |
| 4,586,602 A | | 5/1986 | Levey | |
| 4,714,018 A | * | 12/1987 | Lofgren | 102/275.7 |
| 4,730,560 A | * | 3/1988 | Bartholomew et al. | 102/275.3 |
| 4,771,694 A | | 9/1988 | Bartholomew et al. | |
| 4,815,382 A | | 3/1989 | Yunan | |
| 4,817,787 A | | 4/1989 | Owen | |
| 4,821,645 A | * | 4/1989 | Reiss | 102/275.7 |
| 4,895,249 A | | 1/1990 | Davis et al. | |
| 4,979,352 A | | 12/1990 | Davis et al. | |
| 4,998,478 A | | 3/1991 | Beck | |
| 5,005,694 A | | 4/1991 | Davis et al. | |
| 5,007,230 A | | 4/1991 | Gaston | |
| 5,127,593 A | | 7/1992 | Gaston | |
| 5,216,197 A | * | 6/1993 | Huber et al. | 102/275.2 |
| 5,873,455 A | | 2/1999 | Capers, III | |
| 6,006,671 A | * | 12/1999 | Yunan | 102/275.11 |
| 6,892,645 B2 | | 5/2005 | Nodine | |

FOREIGN PATENT DOCUMENTS

EP 0 602 470 A2 6/1994

* cited by examiner

*Primary Examiner*—Bryon P Gehman
(74) *Attorney, Agent, or Firm*—McCormick, Paulding & Huber LLP

(57) ABSTRACT

A block molded from a polymeric material has a through passageway to contain a percussive shock wave. Angularly related channels communicate with the containment passageway for receiving arcuate segments of detonation cord. Alignment of a plurality of blocks provides a convenient packaging setup for the cord. A percussive signal traveling along the cord can be short-circuited in the packaging setup. A diode version of the block can react to the signal in a given direction of travel.

6 Claims, 5 Drawing Sheets

DIODE CUTOFF AND SAFE PACKAGING SYSTEM FOR DETONATING CORD

CROSS REFERENCE TO RELATED APPLICATION

This application is a Continuation-in-Part to U.S. patent application Ser. No. 10/645,369 filed on Aug. 21, 2003 and titled "Diode Cutoff and Safe Packaging Method for Textile Detonating Cord".

FIELD OF THE INVENTION

The invention relates to the transporting of textile sheathed detonating cord and more particularly to methods used in the packaging of textile detonating cord to achieve a shipping classification allowing shipment of the detonating cord by commercial aircraft. Also the invention relates to the design of an explosive diode to restrict detonation transfer to one direction only.

BACKGROUND OF THE INVENTION

Detonating cords typically contain a secondary high explosive core encased in an outer textile sheath and plastic jacket. Typical explosive materials used are PETN, RDX, HMX, HNS, and PYX. These textile wrapped detonating cords are used extensively in the petroleum exploration and production industry to initiate other explosive components used in various downhole tools. The textile wrapping provides a highly flexible structure that can be easily threaded through perforating guns. Some examples of components that textile detonating cords are used with are perforating shaped charges, setting tools, and similar items. The well locations where these components are used are widely scattered around the world sometimes in very remote locations. It is highly desirable to be able to ship detonating cord by air from a central store location to the remote field location needing the material. However the regulations governing the shipment of explosives by air are quite stringent.

Basically the regulations require that detonating cord explosive materials be packaged in such a manner that an ignition or detonation in one container shall be confined to that container and will not propagate to another container. In practical terms, this means that the maximum amount of detonating cord allowed to detonate in a package is twelve inches to thirty-six inches.

The prior art has several examples of packaging methods that have been used to meet the air shipping regulations for explosive materials. U.S. Pat. No. 4,586,602 discloses a detonating cord transport system where the detonating cord is wound on a plurality of separator support members that provide crossover locations at frequent intervals. At these crossover points, a severing means is wrapped around the cord so that the detonation of one cord portion will sever the continuing cord length at the crossover point without initiating the cord. The maximum length of cord that can detonate without encountering a crossover point is approximately one foot. Packaging of detonating cord using this method is quite laborious and involves inserting severing means around the cord and cable ties to anchor the cord in position.

U.S. Pat. No. 4,817,787 discloses a different packaging method where a mounting board of insulating material, such as expanded polystyrene, is used to hold the cord. Walled paths are molded into the mounting board through which the cord can be threaded. The cord path has a series of loop regions and adjoining parallel regions through which the parallel cord is separated by the wall. The purpose of the wall is to provide a safety distance where the detonation of a length of cord will cause the adjacent parallel length of cord to be severed without initiation. The minimum wall thickness required for the expanded polystyrene is about 0.205" minimum.

U.S. Pat. No. 4,895,249 discusses a packaging method that is claimed to be an improvement over the detonating cord transport system disclosed in the '602 patent. This patent discloses a method that increases the labor efficiency of packaging detonating cord and efficiencies in the quantity of detonating cord per package. In this patent, the detonating cord is also wound on a plurality of separator support members. The cord is wound in loops that cross over itself at frequent locations. At the crossover points a severing means is inserted which serves as a means of stopping the detonation at the crossover point. A preferred example of a severing means is a nylon-reinforced rubber hose that is slit and placed around one cord section at the crossover point. Each separator support layer can accommodate about 25 feet of detonating cord. Twenty stacked layers will therefore allow a total of 500 feet of detonating cord to be shipped in one package.

The prior art disclosed in both the '602 patent and the '787 patent rely on a separate severing means to actually cut the detonating cord. For this system to work, the detonating cord must follow a path very close to the adjacent strand being actually severed. The detonation of the cord will accelerate the independent severing means at high velocity. The material being accelerated actually causes the severing of the detonating cord. For the '249 patent, the severing means is a metal foil sleeve placed over the detonating cord at an actual crossover point.

Both of these packaging methods require that the detonating cord be bent back to either cross over itself or pass dose by in a parallel orientation to insure severing of the detonating cord. Placing severe bends in the detonating cord is detrimental if the cord remains in this packaging orientation for an extended period of time.

In the preferred embodiment of this invention, the detonating cord can be space apart at a greater distance that allows the radius of the loop to be increased to avoid damaging the detonating cord. Also the cord sections pass each other at the severing location in an arcuate configuration that avoids any sharp bends in the detonating cord. This packaging method allows the detonating cord to be stored in this configuration for an extended length of time. Also since no separate severing means is required, there will be a resultant material and labor costs.

It is the objective of the present invention to provide an improved method for packaging detonating cord that will meet the requirements for shipment by commercial air carriers in the United States and internationally. It is another objective of the present invention to obviate the need for a severing means and instead rely on the detonation properties of the cord to sever itself. It is another object of the present invention to provide an explosive diode whereby the propagation of detonation is restricted to one direction only.

DESCRIPTION OF PREFERRED EMBODIMENTS

Figure 1:
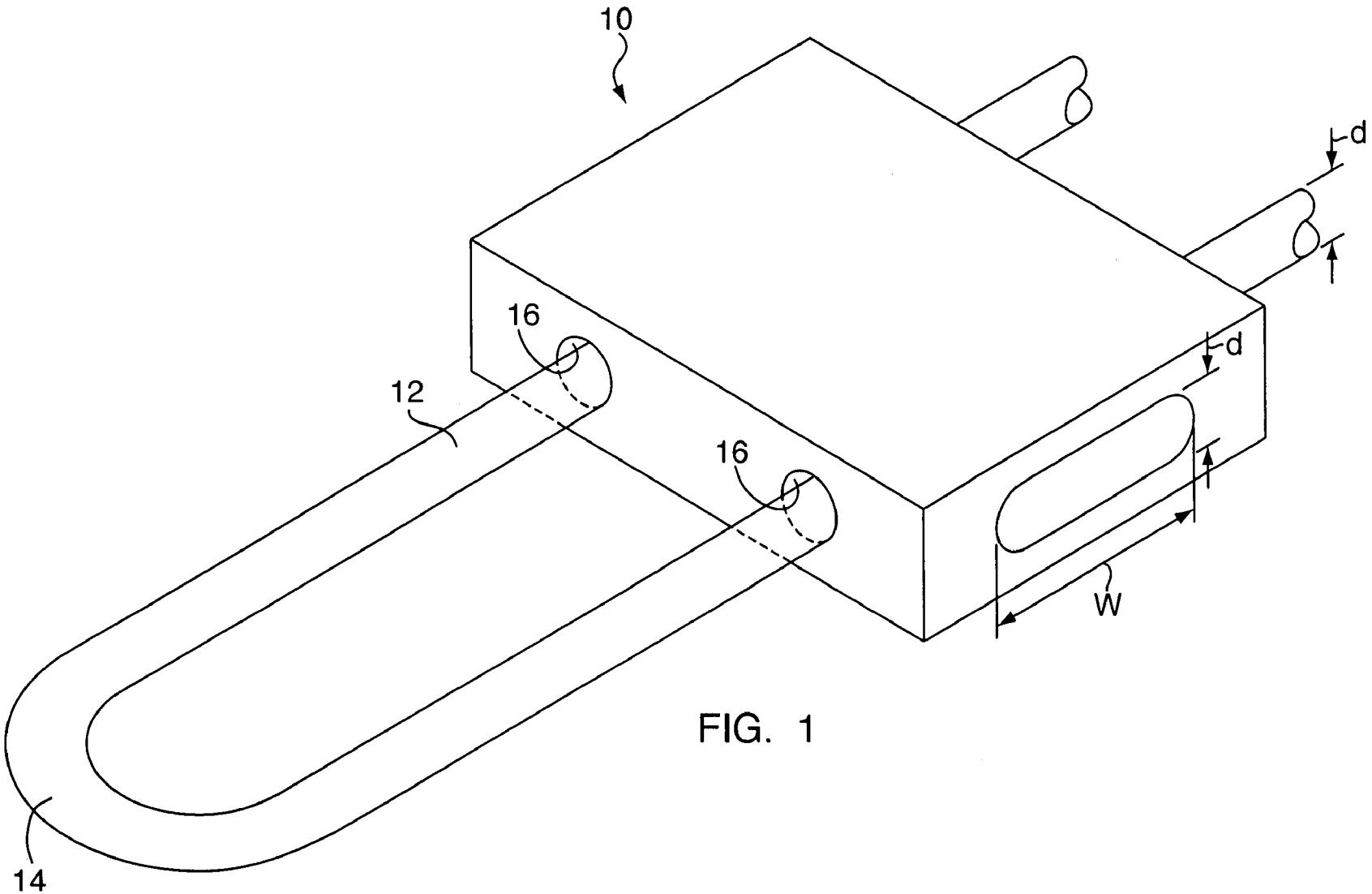
FIG. 1 shows a diode cutoff block with a loop of detonating cord exiting the block.

A diode cutoff block is shown in FIG. 1. In this drawing, the diode cutoff block (10) is shown. The block has two through holes 16, 16 for detonating cord and a channel through the block for focusing the air blast of the detonating cord. Detonating cord (12) passes through the diode block (10) and then forms a loop (14) before the cord passes through the diode block in the opposite direction. The diode block functions by focusing the air blast of the detonating cord through the block and severing the adjacent detonating cord section. The length of the loop (14) must be selected to allow the air blast to sever the adjacent detonating cord before the detonation wave can travel around the loop and pass through the block again.

The block can be made out of a variety of materials such as metal, wood, or plastic. From a cost and weight standpoint, the preferred material is usually plastic. The dimensions of the block are determined by the quantity of explosive loading in the detonating cord. Typically textile detonating cords have an explosive loading ranging from 4 grains per foot to 400 grains per foot. A typical textile detonating cord for the oil well servicing industry has a coreload of about 80 grains per foot. With a higher coreload detonating cord, the distance between the thru holes must be increased slightly and the block made thicker. The actual dimensions are determined by evaluating the severing capabilities of various samples of detonating cord in different block dimensions. For an 80 gr/ft detonating cord, the distance between thru holes ranges from 0.250" to about 1.250". The loop needs to have a minimum detonating cord length of about 6 inches to allow adequate severing of the detonating cord.

Figure 2:
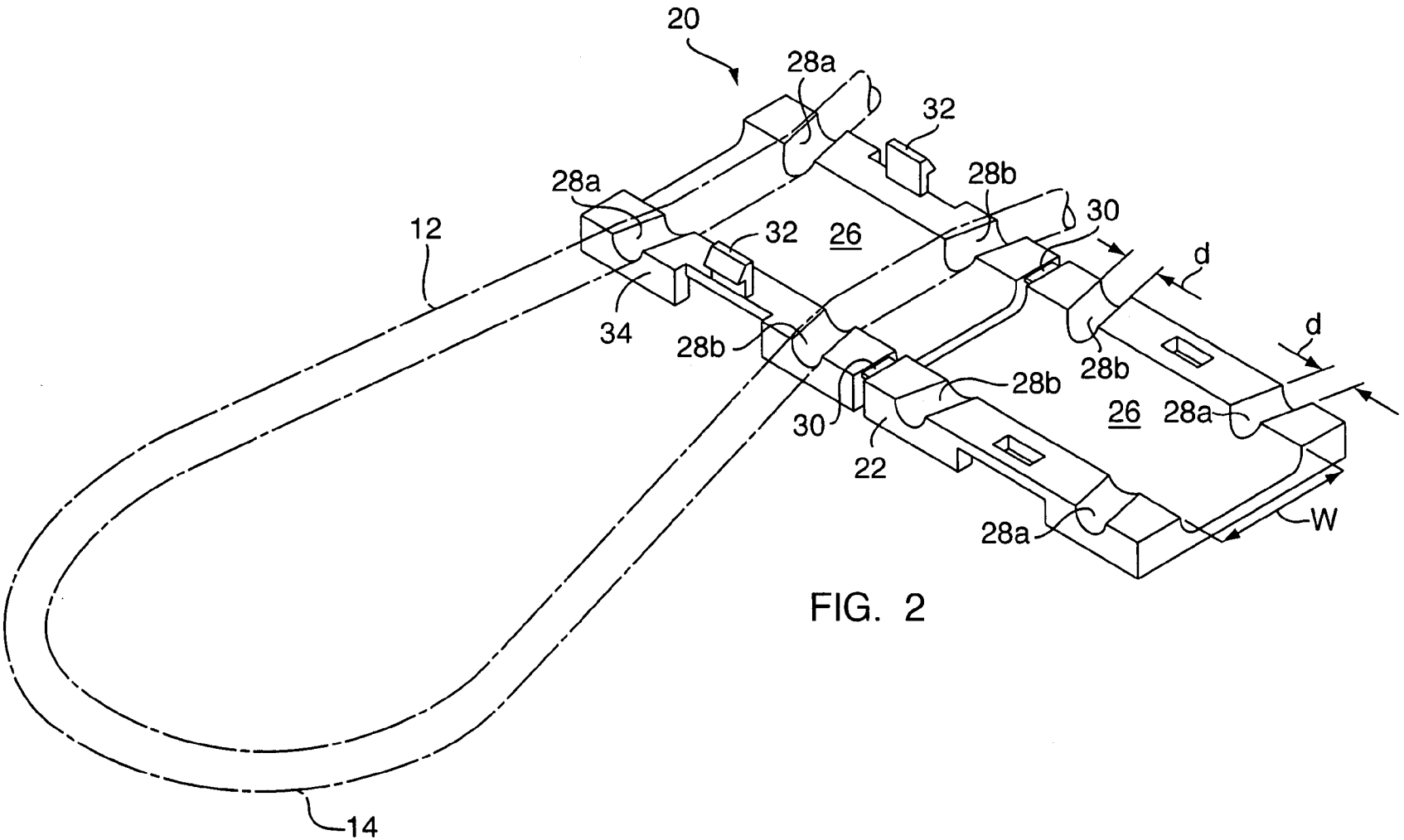
FIG. 2 shows a hinged diode cutoff block with a loop of detonating cord threaded through the base section of the block.

The diode cutoff block illustrated in FIG. 1 is shown as a solid block. While a solid block performs well, it is difficult to attach and remove the block from the detonating cord. An improved diode block is shown in FIG. 2. A hinged plastic block (20) is shown in the open position. A length of detonating cord (12) is shown passing through the block. A slot for the detonating cord (28) is molded into both the base of the hinged block (34) and the lid of the hinged block (22). The lid and the base of the block are joined by a living plastic hinge (30) that allows the block portions to be flexed. Locking tabs (32) hold the block fixed in the dosed position when the block is shut. By pressing the locking tabs (32) together, the block can be opened easily.

When the hinged block is dosed, an air blast channel 26 is formed similar to that in the one-piece block. The functioning of the block 20 is identical to the cutoff block 10 described earlier. When a length of detonating cord detonates, the air blast from the cord will sever the adjacent length prior to the detonation front passing around the loop and back through the block.

Unlike a conventional detonating cord detonator, such as those shown in U.S. Pat. No. 4,771,694 to Bartholomew and U.S. Pat. No. 4,998,478 to Beck, the block of the present invention has a blast channel 26 of width w and height d such that d corresponds to the diameter of the detonating cord. The blast channel extends through from one side to an opposed side of said block. With conventional detonating cord, of outside diameter on the order of ¼" or less, the width w of the blast channel 26 is preferably on the order of one inch. These proportions, coupled with the choice of material for the block, provide a blast focusing effect that assures that a percussion signal in one loop end portion will sever the adjacent end portion of the detonating cord loop. The plastic block is preferably molded from P4G4 polypropylene for this purpose.

The detonating cord loop end portions extend across the blast channel and form a loop of uninterrupted detonating cord, quite unlike the aligned ends of separate detonating cords in a conventional detonator. Slots are defined by the mating base and lid segments of the block, and are oriented transversely of the blast channel, but communicate with it, so that a percussion signal in one end portion of the detonating cord loop in one slot will lead to an air blast in the channel that will sever the detonating cord loop end portion in the adjacent slot.

Figure 3:
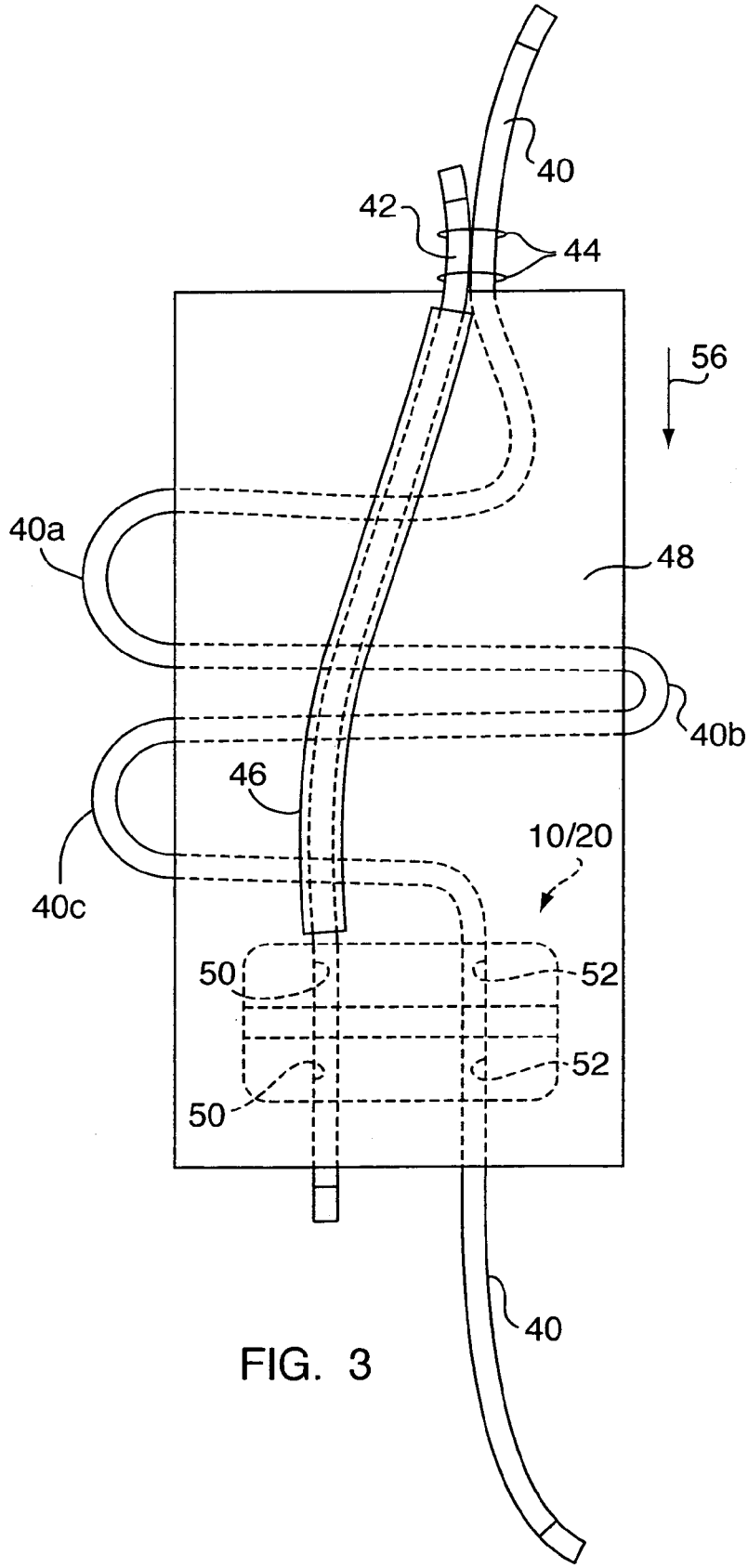
FIG. 3 shows detonating cord assembled in a diode configuration such that a detonation is only allowed to propagate in one direction.

It is also possible to use a diode block as a directional cutoff device. FIG. 3 shows an arrangement of a diode cutoff block that only permits one-way detonation transfer. The main detonating cord transmission line (40) goes from the top of the FIG. 3 drawing to the bottom of the drawing. A diode block (10) is attached to webbing material (48) to hold the block in the correct position. A jumper detonating cord (42) is secured to the main detonating cord (40) with hog rings (44). The other end of the jumper detonating cord passes through the thru hole 50 in the diode block. The main detonating cord (40) passes through the other thru hole 52 in the block. Silicone rubber tubing (46) is placed over the jumper detonating cord to prevent the detonation of the jumper cord from damaging the main detonating cord length (40).

The diode cutoff direction is illustrated by the arrow (56). If the main detonating cord lead 40 is initiated at the top of the figure, the detonation wave will progress towards the bottom of the figure. The main detonating cord will initiate the jumper detonating cord at the hog ring connection (44). The jumper detonating cord is much shorter than the main detonating cord lead that has a series of loops 40*a*, 40*b*, 40*c* in it. Thus the detonation front from the jumper cord 44 will arrive at the diode block 10 and sever the main detonating cord lead at 50/52 before the detonation front from the main lead 40 arrives at the block. Thus the block 10 will function as an explosive diode, permitting the detonation front to pass through the block only in the direction opposite that of the cutoff direction 56.

Figure 4:
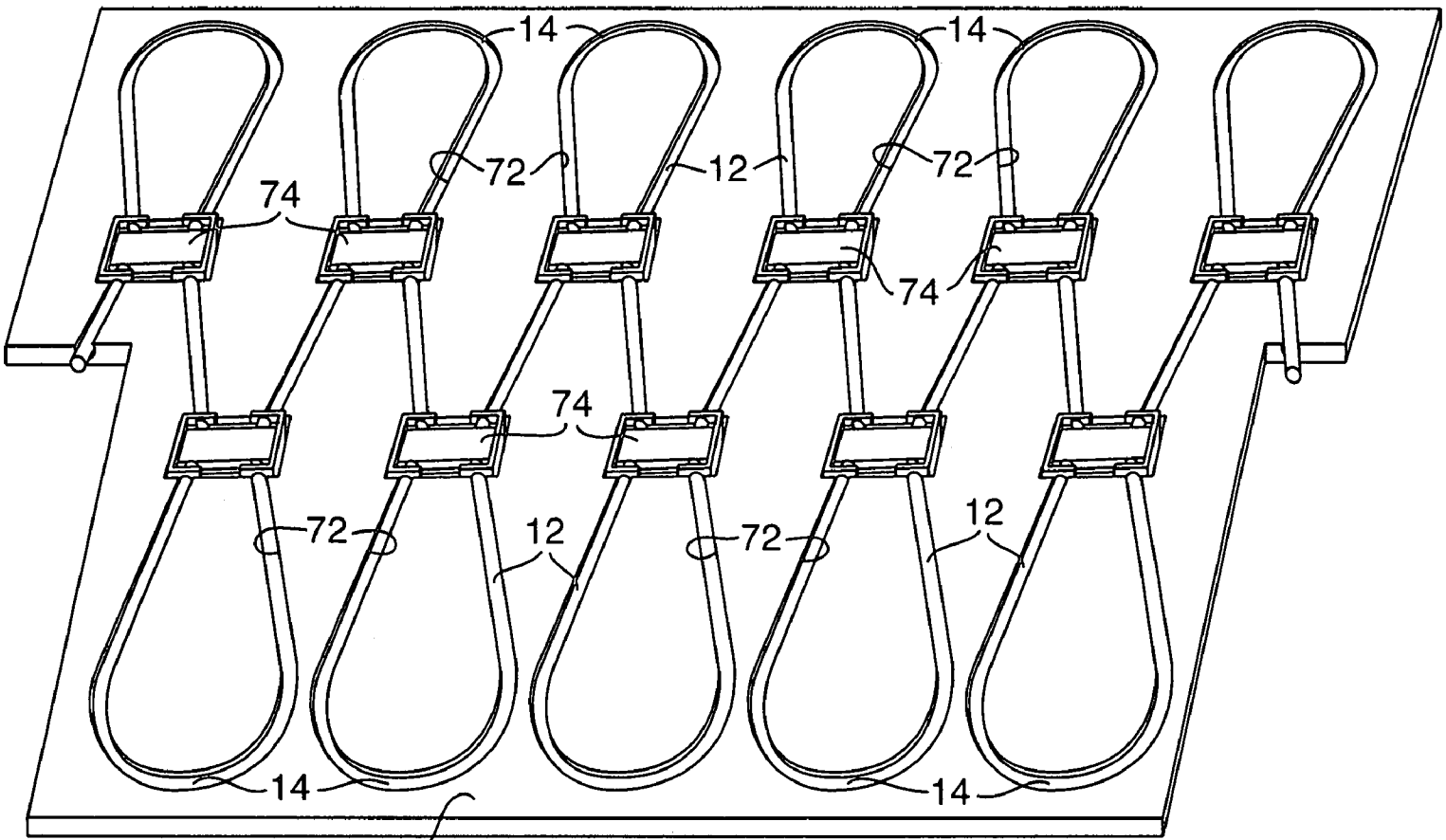
FIG. 4 shows a transport packaging segment where detonating cord and diode blocks are aligned on a foamed polystyrene sheet in a series of loops to allow safe packaging of the detonating cord.

FIG. 4 illustrates a packaging transport section for safe packaging of detonating cord. An expanded polystyrene tray (70) is formed with a series of detonating cord loops (72) molded into the surface of the plastic. The channel for the detonating cord is slightly wider than the diameter of the detonating cord and slightly deeper than the diameter of the detonating cord. This allows accurate positioning of the detonating cord and makes the packaging easy to assemble. Cavities are molded into the tray and sized and dimensioned to receive diode cutoff blocks 74, 74. These blocks 74, 74 may be similar to those described above with reference to FIGS. 1-3. If the detonating cord were to be accidentally initiated in some fashion, the detonation would only propagate until it encounters the first cutoff block.

The length of each loop is about twelve inches. In this design the maximum length of detonating cord that may be detonated is about eighteen inches before the detonating cord will be severed in a diode cutoff block. Each detonating cord transport section holds about eighteen feet of detonating cord. By stacking multiple transport sections, larger quantities of detonating cord can be packaged. For example, stacking twenty-eight transport sections will allow packaging 500 feet of detonating cord in an outer 4G fiberboard box.

Figure 5:
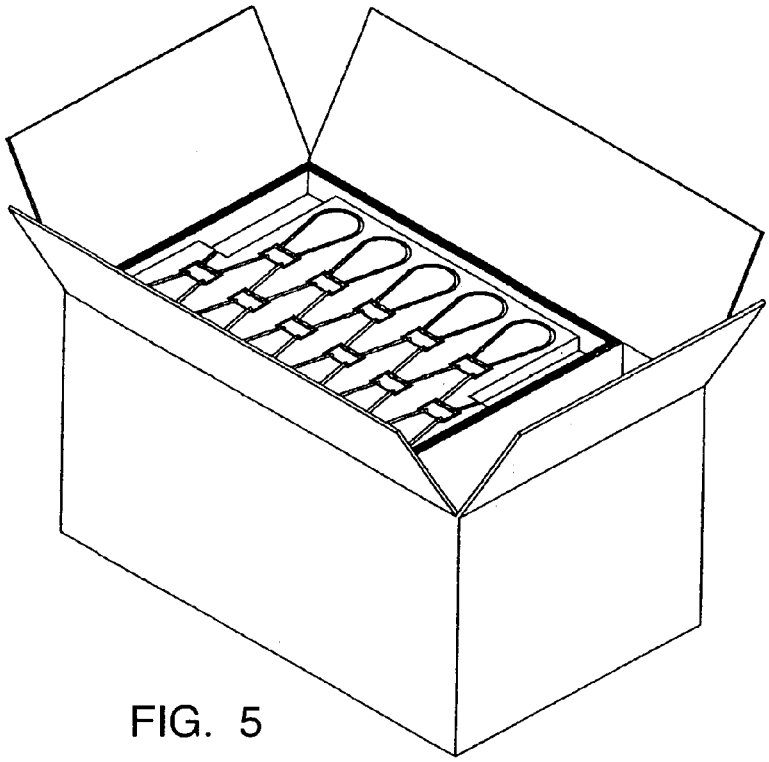
FIG. 5 shows a transport package comprising a stack of sheets such as that shown in FIG. 4.
Figure 6:
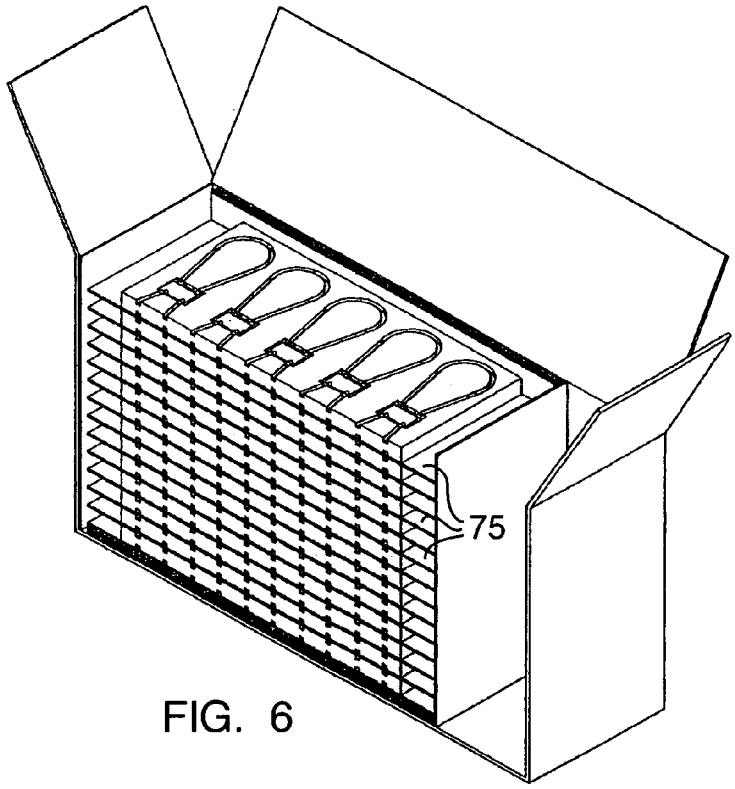
FIG. 6 is a sectional view of the FIG. 5 package showing cardboard separators between the sheets.

FIGS. 5 and 6 show a complete packaging for a stack of sheets 70, 70 such as that shown in FIG. 4. FIG. 6 shows separator pads 75 between the foam sheets or trays 70, 70.

Thus, block 20 in FIG. 2 provides a slightly arcuate shape for the detonating cord logs segments contained in the slot and this configuration avoids any necessity for a separate severing means to act on the detonating cord when an unwanted percussive signal passes through the adjacent cord end portions. The geometry of the containment or blast passageway and of the slots verified in proprietary tests conducted by an independent testing laboratory, yielded good results. The recommendation of that laboratory was to classify the packaging described herein as meeting federal requirements for transporting by highway, by rail, and by civil aircraft in the USA.

The foregoing disclosure and the embodiments shown in the drawings are merely illustrative of the principles of this invention and are not to be interpreted in a limiting sense.

What is claimed is:

1. For a detonating cord packaging system wherein a plurality of detonating cord retention devices provide loops of detonating cord in a continuous pattern such that the loop end portions are arranged outwardly of each device, each device comprising:

a polymeric block defining a blast channel open to opposed ends of said block, said channel defining a central axis, said block including an upper segment and a lower segment of complementary shape, said upper and lower segments defining slots for receiving portions of the detonating cord loops, said slots being oriented transversely relative to said channel central axis, said slots being closely spaced and in communication with said channel and being open to opposed sides of said block, said upper and lower segments further defining interlocking aperture and tab means for holding said segments in assembled relationship, whereby the detonating cord loops will cross said blast channel in closely spaced relation to one another.

2. The devices according to claim 1 wherein said slots have their respective central axes in the same common plane that contains said blast channel central axis.

3. The devices according to claim 2 wherein said channel is of greater width than height, said channel width measured in said common plane and said channel height measured perpendicular said common plane, said slots being circular and having a diameter substantially the same as said channel height.

4. A detonating cord packaging system comprising detonating cord arranged in oppositely disposed continuous loops, end portions of these loops oriented adjacent to one another in a common plane, at least one polymeric block, each block defined by an upper segment and a lower segment; that complement one another to define slots for accommodating said adjacent loops, said segments further defining interlocking aperture and tab means for holding said segments in assembled relationship to clamp said loops, and a blast channel open to opposed ends of said block and defined by said segments, said channel communicating with said slots so that the central axis of said blast channel lies in said common plane, whereby said loops are clamped between said upper and lower segments in close proximity to one another in said channel.

5. The packaging system according to claim 4 wherein said slots have respective slot axes in said common plane, said slots being open to opposite sides of said block, and each said block further including a self hinge defined at one of said opposed ends associated with said channel.

6. A detonating cord packaging system comprising a continuous detonating cord arranged in continuous loops, end portions of said loops arranged adjacent to one another, a housing having openings receiving said loops so that the end portions of said loops are arranged outwardly of sides of the housing so that the detonating cord extends from one end of said housing to an opposite end in a serpentine course defined by said loops and said openings, said housing further defining a shunt channel extending directly from said one end to said opposite end of said housing, a jumper detonating cord in said shunt channel, and said jumper detonating cord having an outer sheath to shield it from igniting adjacent detonating cord portions passing through said openings, and a detonating cord severing device adjacent said opposite end of said housing, said severing device having a blast channel and transverse slots communicating with said blast channel and receiving said jumper detonating cord and said continuous detonating cord at said opposite end in closely spaced relation to one another, whereby the housing, the severing device, the continuous detonating cord and the jumper detonating cord function as a diode responsive to a directional signal in said continuous detonating cord from said one end to said opposite end of said housing.

* * * * *